US006427802B1

(12) United States Patent
Yokoi et al.

(10) Patent No.: US 6,427,802 B1
(45) Date of Patent: Aug. 6, 2002

(54) MUFFLER

(75) Inventors: Masayuki Yokoi, Nagoya; Masahiro Maeno, Aichi; Masayoshi Tange, Nagoya, all of (JP)

(73) Assignee: Sango Co., Ltd., Nagoya (JP)

( * ) Notice: Subject to any disclaimer, the term of this patent is extended or adjusted under 35 U.S.C. 154(b) by 0 days.

(21) Appl. No.: 09/701,137

(22) PCT Filed: May 26, 1999

(86) PCT No.: PCT/JP99/02771

§ 371 (c)(1),
(2), (4) Date: Nov. 24, 2000

(87) PCT Pub. No.: WO99/61762

PCT Pub. Date: Dec. 2, 1999

(30) Foreign Application Priority Data

May 26, 1998 (JP) ..... 10-143932

(51) Int. Cl.[7] ..... F01N 7/18

(52) U.S. Cl. ..... 181/282; 181/265; 181/272

(58) Field of Search ..... 181/264, 265, 181/269, 272, 279, 280, 281, 282

(56) References Cited

U.S. PATENT DOCUMENTS

| | | | | | |
|---|---|---|---|---|---|
| 3,232,374 | A | * | 2/1966 | Powers | 181/272 |
| 3,675,734 | A | * | 7/1972 | Blatt et al. | 181/264 |
| 4,673,058 | A | * | 6/1987 | Roberts et al. | 181/272 |
| 5,440,083 | A | * | 8/1995 | Masuda | 181/282 |
| 5,559,308 | A | * | 9/1996 | Hayashi | 181/272 |
| 5,563,385 | A | * | 10/1996 | Harwood | 181/282 |

FOREIGN PATENT DOCUMENTS

| | | |
|---|---|---|
| JP | 49-128144 | 12/1974 |
| JP | 49-129034 | 12/1974 |
| JP | 60-38114 | 3/1985 |
| JP | 62-79918 | 5/1987 |
| JP | 2-40914 | 3/1990 |
| JP | 4-314913 | 11/1992 |

* cited by examiner

*Primary Examiner*—Khanh Dang
(74) *Attorney, Agent, or Firm*—Pillsbury Winthrop LLP

(57) ABSTRACT

A muffler in which in order to reduce a harsh high-frequency component exhaust noise as exhaust noise of a vehicle, and relieve a feeling of discomfort due to the exhaust noise, on at least one of an inner plate and an outer plate, a plurality of dot-shaped convex portions 15 and dot-shaped concave portions 16 are provided, and the convex portions 15 and concave portions 16 are alternately arranged to be surrounded with each other. Furthermore, the convex portion 15 is connected to the concave portion 16 by a curved surface.

13 Claims, 4 Drawing Sheets

MUFFLER

This application is the national phase of international application PCT/JP99/02771 filed May 26, 1999 which designated the U.S.

TECHNICAL FIELD

The present invention relates to a muffler.

BACKGROUND ART

As a conventional internal combustion engine muffler, a muffler has been generally employed which is, as shown in FIG. 7, constituted by dividing a main body formed of a shell 101 and outer plates 102, 103 into expansion chambers 106, 107 and a resonance chamber 108 by inner plates 104, 105. Furthermore, the muffler is constituted of an inlet pipe 109 for introducing exhaust gas, an outlet pipe 110 for discharging the exhaust gas to the atmosphere, and an inner pipe 111 for connecting the respective chambers to each other.

Moreover, as shown as the outer plates 102, 103 and inner plates 104, 105 in FIGS. 7, 8A and 8B, it is known that connection holes 112 for passing the respective pipes are formed in a flat plate molded by press processing, and linear ribs (beads) 114 are formed in a plane portion 113 excluding the connection holes 112, so as to restrain surface vibration of the outer plates 102, 103 and inner plates 104, 105, and to prevent abnormal noise and breakage caused by the surface vibration.

In the outer plates 102, 103 and inner plates 104, 105, since the plane portion 113 except the ribs 114 is formed in a broad range, in parallel and opposite arrangement of these plates, a high frequency component of the exhaust noise is reflected to the broad plane portion 113 to reciprocate many times between the opposite plates. Therefore, with respect to the exhaust noise with a specified frequency, sharp resonance occurs, reverberation time is lengthened, and further a flutter echo phenomenon occurs, which causes a secondary noise in the muffler.

Moreover, when the rib 114 is linearly formed as described above, diffused reflection of exhaust noise occurs in a direction perpendicular to a linear direction of the rib 114, but no irregular reflection occurs in the linear direction. Therefore, the reflected high frequency component of exhaust noise fails to sufficiently interfere with each other, and secondary noise is insufficiently restrained.

DISCLOSURE OF THE INVENTION

Therefore, an object of the present invention is to provide a muffler in which by enhancing vibration-damping effects of outer and inner plates, and by effectively utilizing a limited plate area to form many irregular reflection elements, the exhaust noise can be reduced as compared with the aforementioned conventional plate.

In order to attain the aforementioned objects, according to the present invention, there is provided a muffler in which an inside is divided into a plurality of chambers by at least an inner plate, a plurality of dot-shaped convex and concave portions are provided in at least one of the inner plate and the outer plate, the convex portions and the concave portions are alternately arranged to be surrounded with one another, and the convex portion is connected to the concave portion by a curved surface.

In the present invention, since high frequency components of the exhaust noise having hit the dot-shaped convex and concave portions are diffusely reflected to interfere with each other in all spatial directions, the secondary noise is restrained, and the exhaust noise is reduced as compared with the conventional art. Furthermore, since the convex and concave portions are alternately disposed and connected to each other by the curved surfaces, plate surface rigidity is enhanced, and abnormal noise and breakage by plate vibration can also be prevented.

Moreover, in the present invention, the convex and concave portions may be disposed substantially on the entire surface of the plate.

Thereby, the aforementioned irregular reflection is performed substantially on the entire surface of the plate, and the exhaust noise is further reduced.

Furthermore, in the present invention, a burring portion for passing a pipe can also be disposed on the convex or concave portion.

Pipe vibration is restrained by providing the burring portion without deteriorating the plate surface rigidity.

Moreover, in the present invention, the convex and concave portions may be provided on the outer and inner plates disposed opposite to each other or the inner plates disposed opposite to each other.

By disposing the plates with the convex and concave portions disposed thereon opposite to each other, the aforementioned reduction effect of the exhaust noise is further enhanced.

BEST MODE FOR CARRYING OUT THE INVENTION

Embodying modes according to the present invention will be described based on embodiments shown in FIGS. 1 to 6.

Figure 1:
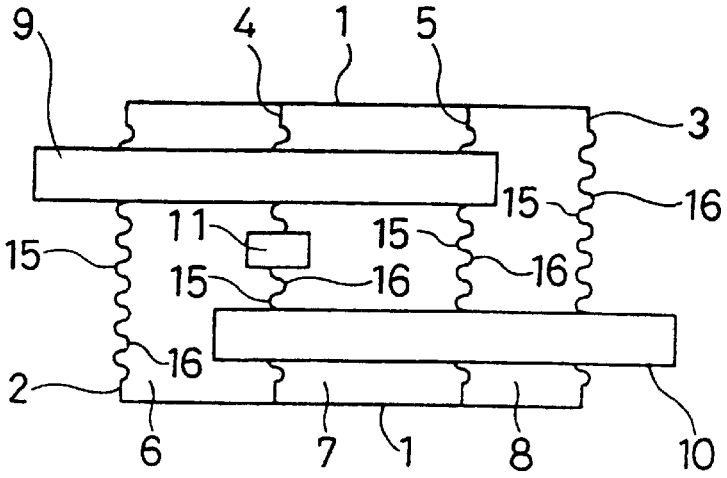
FIG. 1 is a schematic sectional view showing an embodiment of a muffler according to the present invention in which convex and concave portions are provided on all plates.

FIG. 1 shows an embodiment of a muffler in which the present invention is applied to outer and inner plates.

In FIG. 1, a main body formed by a shell 1 and outer plates 2, 3 is divided into three chambers 6, 7, 8 by two inner plates 4, 5. Moreover, an inlet pipe 9, an outlet pipe 10, and an inner pipe 11 are passed through the plates and arranged as shown in FIG. 1. The respective members are formed of metal plates.

The outer plates 2, 3 and inner plates 4, 5 are provided with convex and concave portions as irregular reflection elements according to the present invention, and the irregular reflection elements will be described in detail using the inner plate 4 as an example with reference to FIGS. 2A to 2C.

Figure 2A:
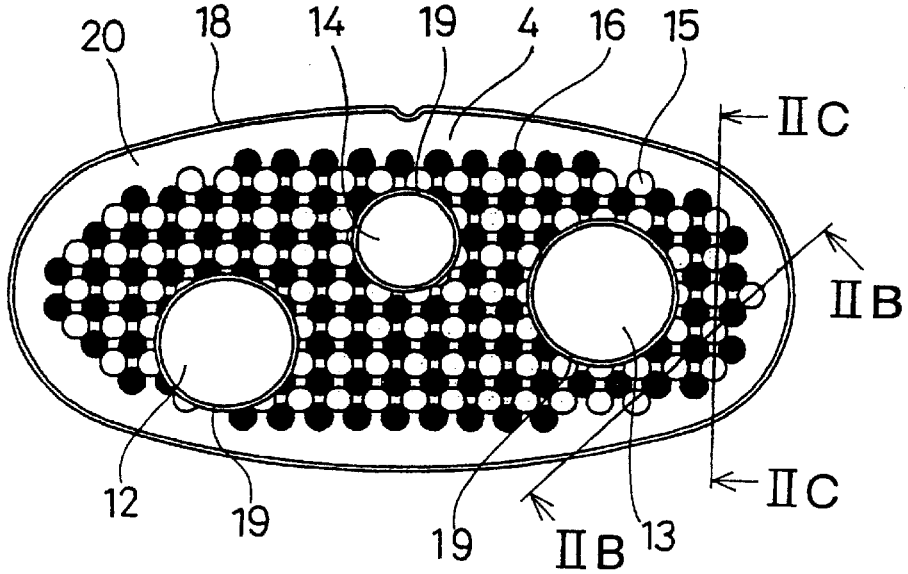
FIG. 2A is a front view of an inner plate showing an embodiment of an arrangement state of the convex and concave portions of the present invention.

FIG. 2A is a front view of the inner plate 4, and a connection hole 12 in the inlet pipe 9, connection hole 13 in the outlet pipe 10 and connection hole 14 in the inner pipe 11 are formed through the inner plate.

The entire surface excluding the respective connection holes 12 to 14 and an outer peripheral portion of the plate 4 is dotted with hemispherical convex portions 15 and hemispherical concave portions 16 formed by press processing with respect to one surface (front surface) of the inner plate 4. Additionally, in FIG. 2A the convex portion 15 is shown by a white circle, and the concave portion 16 is shown by a black circle.

In these convex portions 15 and concave portions 16, one convex portion 15 is surrounded with four concave portions 16, and one concave portion 16 is surrounded with four convex portions 15. Furthermore, the convex portion 15 and concave portion 16, the convex portion 15 and convex portion 15, or the concave portion 16 and concave portion 16, which are disposed adjacent to each other, are connected to each other by a smooth curved surface as shown in FIGS. 2B, 2C. Furthermore, around the connection holes 12 to 14, burrings 19 for making the pipe pass through are positioned on the convex portions 15 or the concave portions 16 and formed in a bent shape. Additionally, the convex portion 15 and concave portion 16 may be provided on the entire surface of the plate, but in the embodiment of FIG. 2A, a plane portion 20 for pressing a jig onto the outer peripheral portion of the plate 4 during insertion of the plate 4 into the shell 1 in a muffler assembly process is provided on the outer peripheral portion of the plate 4.

A flange 18 for engagement with the shell 1 is formed in a bent shape around the inner plate 4.

As described above, since both the dot-shaped convex portions 15 and the dot-shaped concave portions 16 are provided, high frequency components of the exhaust noise having hit the convex portions 15 and concave portions 16 are diffusely reflected in all spatial directions to interfere, secondary noise is therefore restrained, and the exhaust noise (ejection noise and emission noise from the muffler) is reduced as compared with the conventional muffler. Particularly, for an exhaust noise of a vehicle, a harsh high frequency component exhaust noise is mainly reduced, and a feeling of discomfort in the exhaust noise is relieved.

Furthermore, by forming the convex portion 15 and the concave portion 16 in the dot shapes as described above, these portions can be arranged with a high density, and by the high-density arrangement, the irregular reflection and interference of the high frequency component are sufficiently caused so that the exhaust noise can further be reduced.

Additionally, by connecting the convex portion 15 to the concave portion 16 via the curved surface as described above, the convex portion 15 is smoothly connected to the concave portion 16. Therefore, since a small-rigidity plane heretofore present between the portions can be removed, the surface rigidity of the plates 2 to 5 is enhanced, and abnormal noise and breakage by vibration of the plates 2 to 5 can further be prevented.

Moreover, as described above, there is an effect that pipe vibration is restrained by providing the burring portion 19 on the convex portion 15 or the concave portion 16.

Furthermore, the exhaust noise of a broad high-frequency band can be reduced by setting the convex portion 15 to be high, but the height of the convex portion 15 alone is limited by forming limit. However, by alternately arranging the convex portion 15 and concave portion 16 close to each other as described above, an effect similar to the effect obtained by increasing the height of the convex portion 15 can be obtained and processing can be facilitated.

Additionally, the convex portions 15 and concave portions 16 may be provided substantially on the entire surface of the plate 4.

When the convex portions 15 and concave portions 16 are provided substantially on the entire surface of the plate in this manner, the aforementioned respective effects are further enlarged.

Moreover, the convex portion 15 and the concave portion 16 in the aforementioned embodiment are formed in the hemispherical shapes, but the convex portion 15 and the concave portion 16 may be formed in a semielliptical shape, a conical shape, or a pyramidal shape.

Furthermore, in the aforementioned embodiment, a size of the convex portion 15 may differ from the size of the concave portion 16.

Additionally, the present invention may be applied to the inner plate in which a large number of small holes are formed to rectify an exhaust gas flow and silence the noise thereof.

Moreover, a ratio of the convex portion 15 to the entire surface of the plate, or the ratio of the concave portion 16 thereto, and further the ratio between the convex portion 15 and concave portion 16 are optionally set in accordance with the muffler constitution, reverberation time of the respective chambers, and the like.

Figure 2B:
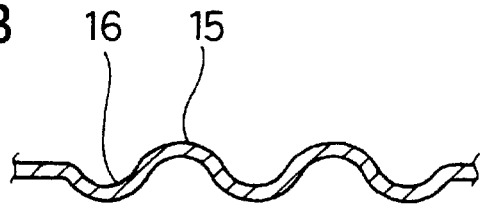
FIG. 2B is a sectional view taken along a line IIB—IIB in FIG. 2A.
Figure 2C:
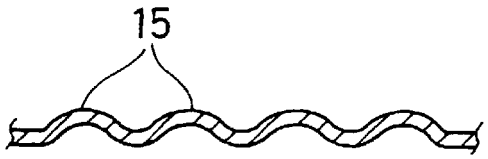
FIG. 2C is a sectional view taken along a line IIC—IIC in FIG. 2A.
Figure 3:
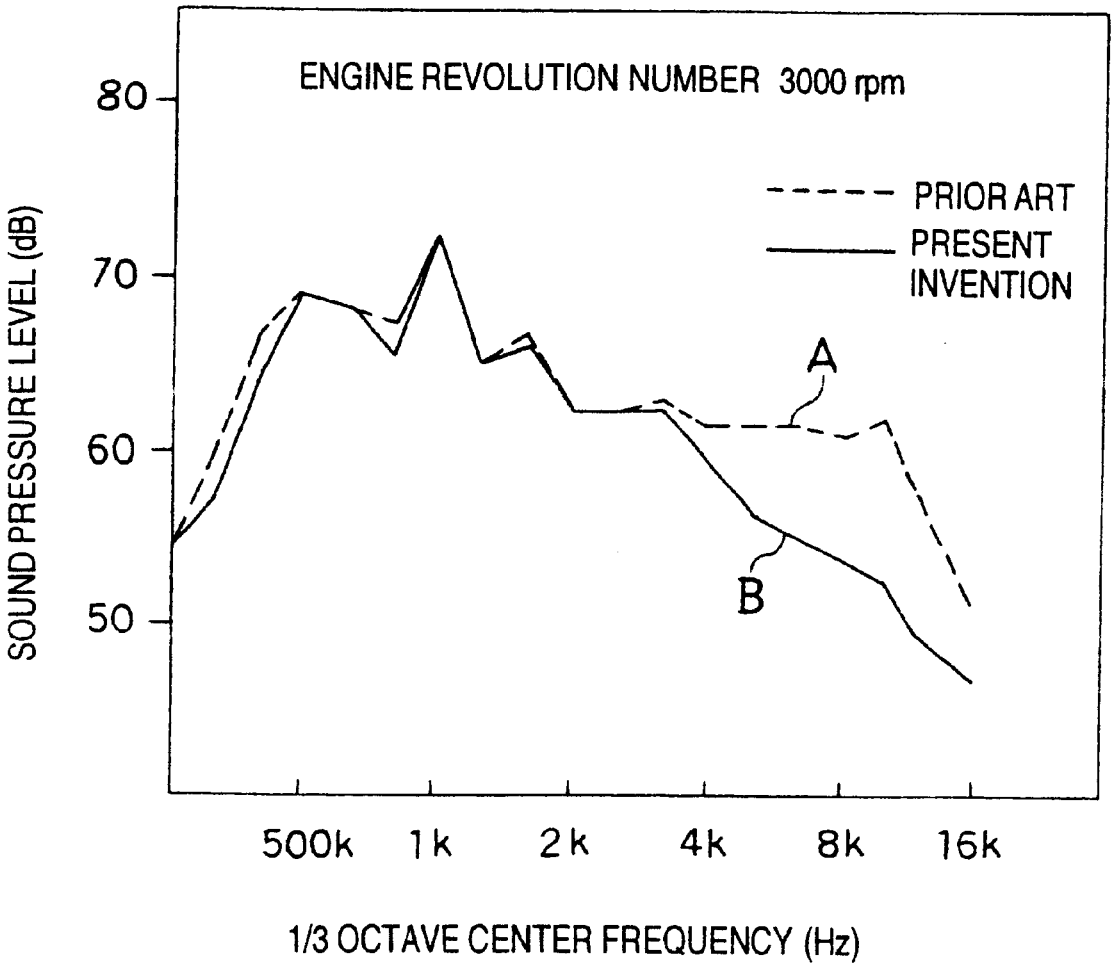
FIG. 3 is a diagram showing muffling properties of the muffler using the plate of the embodiment according to the present invention and a conventional muffler.

FIG. 3 shows a result of measurement of sound pressure levels of respective frequencies by a ⅓ octave analyzer with respect to exhaust sound in an engine revolution number of 3000 rpm when using the conventional muffler provided with the simply planar inner plates and using the muffler provided with the inner plates 4, 5 with the convex portions 15 and concave portions 16 formed thereon as shown in FIGS. 2A to 2C according to the present invention.

As the measurement result, the conventional muffler showed property A in FIG. 3, while the muffler of the present invention showed property B.

As apparent from the measurement result, the exhaust noise of the high frequency component was reduced in the muffler of the present invention.

Figure 4:
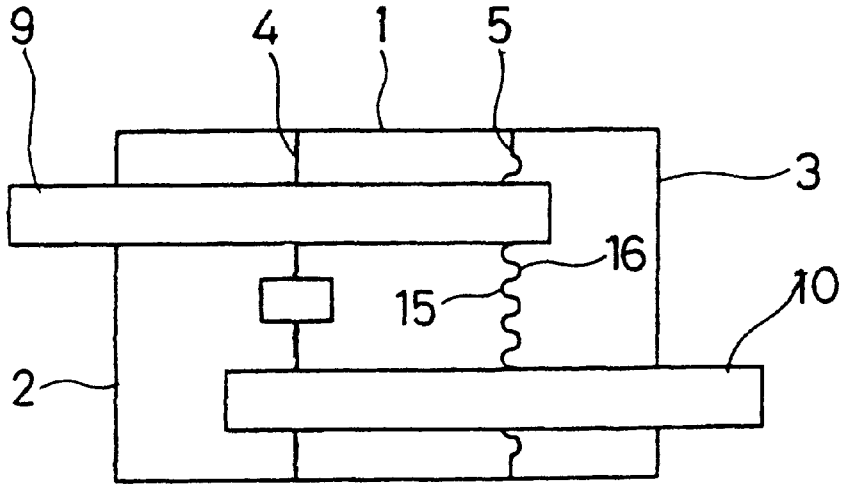
FIG. 4 is a schematic sectional view of a muffler in which convex and concave portions are provided on one inner plate in another embodiment according to the present invention.
Figure 5:
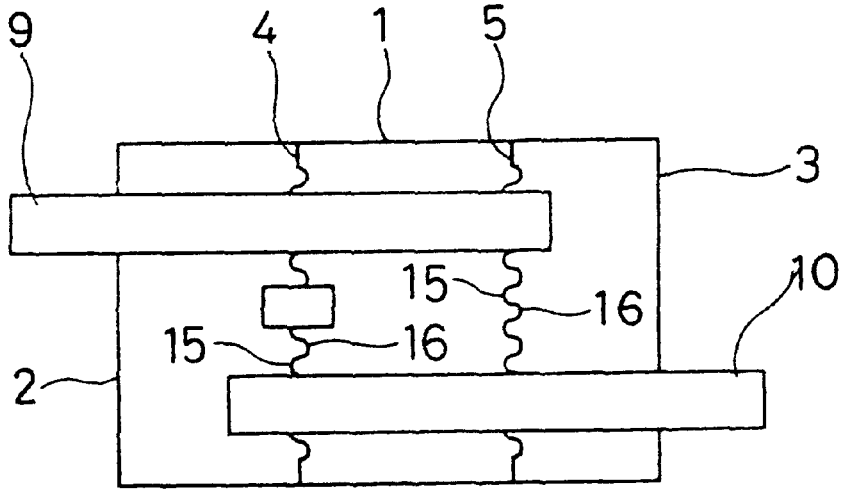
FIG. 5 is a schematic sectional view of a muffler in which the convex and concave portions are provided on two opposite inner plates in still another embodiment according to the present invention.
Figure 6:
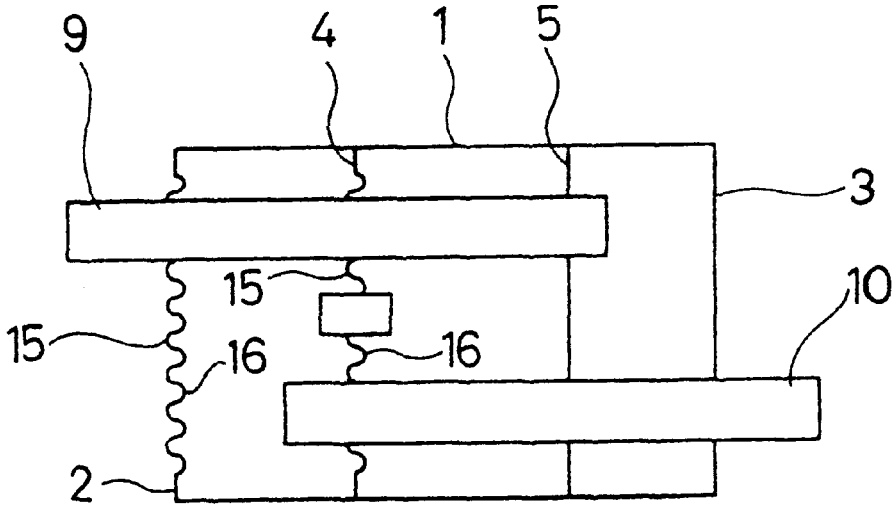
FIG. 6 is a schematic sectional view of a muffler in which convex and concave portions are provided on outer and inner plates disposed opposite to each other in further embodiment according to the present invention.
Figure 7:
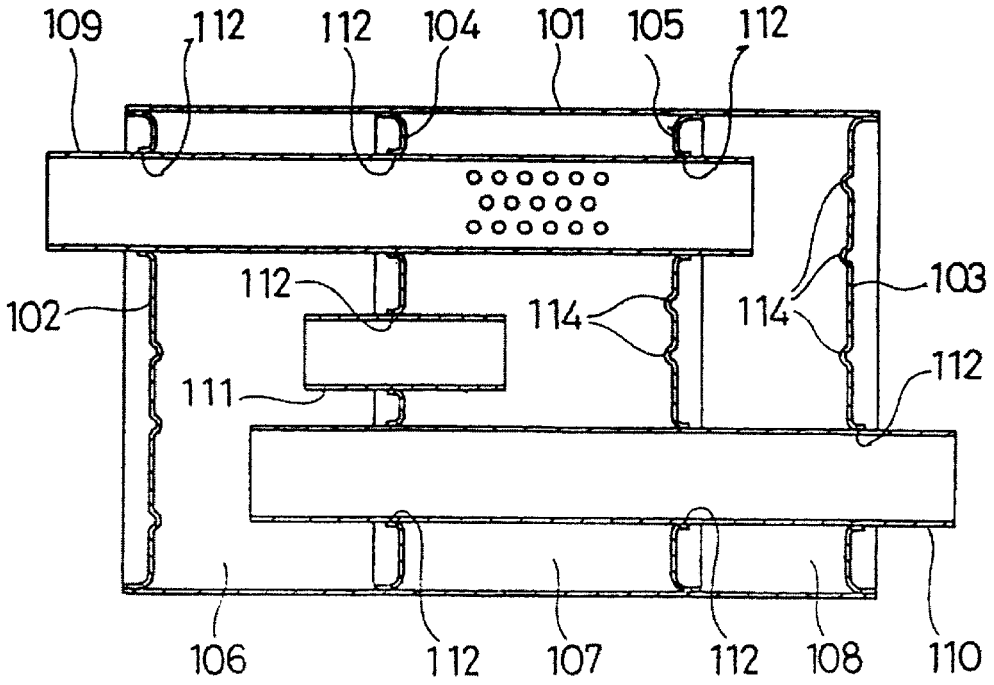
FIG. 7 (RELATED ART)
FIG. 7 is a schematic sectional view showing a conventional muffler.
Figure 8A:
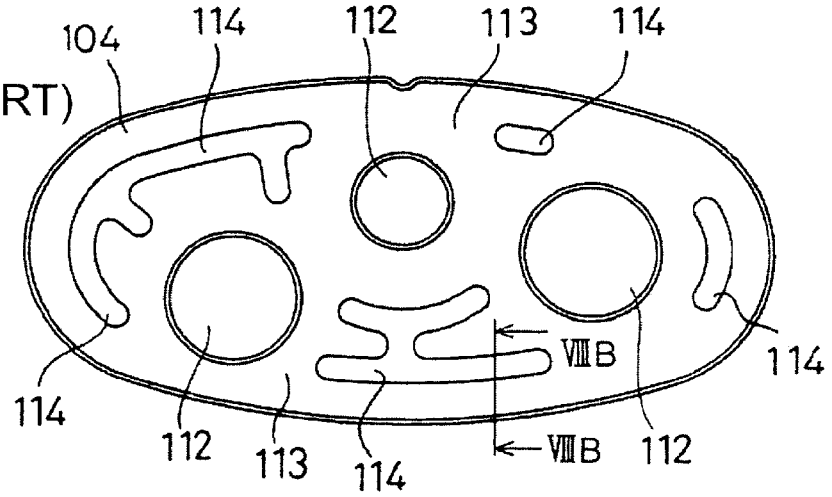
FIG. 8A (RELATED ART)
FIG. 8A is a front view of the inner plate in the muffler of FIG. 7.
Figure 8B:
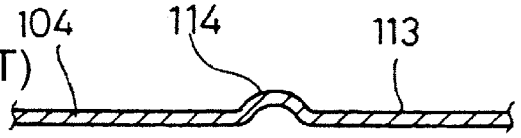
FIG. 8B (RELATED ART)
FIG. 8B is a sectional view taken along a line VIIIB—VIIIB in FIG. 8A.

In the embodiment of FIG. 1, both outer plates 2, 3 provided with the aforementioned convex portions 15 and concave portions 16 are disposed opposite to both inner plates 4, 5 provided with the convex portions 15 and concave portions 16 to constitute the muffler, but in another embodiment of FIG. 4, one inner plate 5 may be provided with the aforementioned convex portions 15 and concave portions 16, or as in still another embodiment shown in FIG. 5, the inner plates 4, 5 disposed opposite to each other may be provided with the convex portions 15 and concave portions 16, further as in another embodiment shown in FIG. 6, the convex portions 15 and concave portions 16 may be provided on the outer plate 2 (or 3) and the inner plate 4 (or 5) disposed opposite to each other. Furthermore, it is optional to provide the convex portions 15 and concave portions 16 on either one of the aforementioned plates.

Even when one plate is provided with the convex portions 15 and concave portions 16 as shown in FIG. 4, the aforementioned effect is fulfilled as compared with the conventional muffer, but the effect is further enlarged by providing the convex portions 15 and concave portions 16 on the opposite plates.

POSSIBILITY OF INDUSTRIAL UTILIZATION

As described above, according to the present invention, particularly, as the exhaust noise of the vehicle the harsh high-frequency component exhaust noise is reduced as compared with the conventional muffer, and the discomfort by the exhaust noise can be moderated. Furthermore, since the exhaust noise is further diffusely reflected by the convex and concave portions, the exhaust noise can further be reduced. Additionally, the plate surface rigidity is enhanced, and the abnormal noise and breakage by the plate vibration can also be prevented.

Moreover, in the present invention, by providing the convex portions or the concave portions substantially on the entire surface of the plate, the aforementioned exhaust noise can further be reduced.

Furthermore, by providing the burring portion for passing the pipe on the convex portion or the concave portion, the pipe vibration can be depressed.

Additionally, by providing the convex portions and concave portions on the opposite outer plate and the inner plate or the opposite inner plates, the aforementioned exhaust noise reducing effect can further be enhanced.

What is claimed is:

1. A muffler, comprising:

a main body formed of a shell and outer plates; and at least one inner plate, disposed inside the shell between the outer plates, defining a plurality of chambers, wherein a plurality of convex portions and a plurality of concave portions are formed on a surface of at least one of a) the at least one inner plate and b) at least one outer plate, the convex portions and the concave portions being alternately arranged adjacently to be at least partially peripherally surrounded with one another and wherein each concave portion and each convex portion is connected with an adjacent concave portion and convex portion, respectively, via a curved surface other than one of the concave and convex portions.

2. The muffler according to claim 1, wherein the convex portions and the concave portions are provided substantially on the entire surface of at least one of a) the at least one inner plate and b) at least one outer plate.

3. The muffler according to claim 1, wherein a burring portion for passing a pipe is provided on at least one of a) the convex portions and b) the concave portions.

4. The muffler according to claim 2, wherein a burring portion for passing a pipe is provided on at least one of a) the convex portions and b) the concave portions.

5. The muffler according to claim 1, wherein the at least one inner plate includes a plurality of inner plates and the convex portions and the concave portions are provided on at least one of a) the outer plate and the inner plate disposed opposite to each other and b) the inner plates disposed opposite to each other.

6. The muffler according to claim 2, wherein the at least one inner plate includes a plurality of inner plates and the convex portions and the concave portions are provided on at least one of a) the outer plate and the inner plate disposed opposite to each other and b) the inner plates disposed opposite to each other.

7. The muffler according to claim 3, wherein the at least one inner plate includes a plurality of inner plates and the convex portions and the concave portions are provided on at least one of a) the outer plate and the inner plate disposed opposite to each other and b) the inner plates disposed opposite to each other.

8. The muffler according to claim 4, wherein the at least one inner plate includes a plurality of inner plates and the convex portions and the concave portions are provided on at least one of a) the outer plate and the inner plate disposed opposite to each other and b) the inner plates disposed opposite to each other.

9. The muffler according to claim 1, wherein the convex portions and the concave portions are formed by a pressing process.

10. The muffler according to claim 1, wherein the convex portions and the concave portions are one of hemispherically shaped, semielliptically shaped, conically shaped, and pyramidally shaped.

11. The muffler according to claim 1, wherein a height of the convex portions is equal to a height of the concave portions.

12. The muffler according to claim 1, wherein a height of the convex portions is different from a height of the concave portions.

13. The muffler according to claim 1, wherein the convex portions and the concave portions are connected to each other by a curved surface.

* * * * *